US006904862B1

(12) United States Patent
Chustak

(10) Patent No.: US 6,904,862 B1
(45) Date of Patent: Jun. 14, 2005

(54) TRACK FOR LOCATING A LADDER WITH RESPECT TO A GATE ON A DECK

(76) Inventor: Daniel A. Chustak, 602 E. Eckman St., South Bend, IN (US) 46614

( * ) Notice: Subject to any disclaimer, the term of this patent is extended or adjusted under 35 U.S.C. 154(b) by 17 days.

(21) Appl. No.: 10/772,125

(22) Filed: Feb. 4, 2004

(51) Int. Cl.[7] ..... B63B 17/00
(52) U.S. Cl. ..... 114/362; 182/36
(58) Field of Search ..... 114/362; 182/36, 182/97

(56) References Cited

U.S. PATENT DOCUMENTS 3,862,670 A * 1/1975 Hovey ..... 182/89
3,980,157 A * 9/1976 Wrigley ..... 182/163
4,846,303 A 7/1989 Cooper
5,117,940 A * 6/1992 Garelick ..... 182/97

* cited by examiner

*Primary Examiner*—Sherman Basinger
(74) *Attorney, Agent, or Firm*—Leo H McCormick, Jr.

(57) ABSTRACT

A track has a housing with a bore therein that extends from a first end to a second end, a linear slot at the top of the bore, a radial projection perpendicular to the linear slot, an axial groove in the bore, a plurality of radial openings that extend through the radial projection, a first leg thereon tangent to the top and a second leg tangent to the bottom of the bore. First and second cylindrical members on a ladder are located in the bore and a bolt inserted into each radial opening. Each bolt has a head that is located in the axial groove and a shaft that extends through an opening in a deck on a watercraft. A nut attached to each shaft such that the legs and a base on the radial projection are urged into engagement with the deck to affix the ladder to the deck.

11 Claims, 3 Drawing Sheets

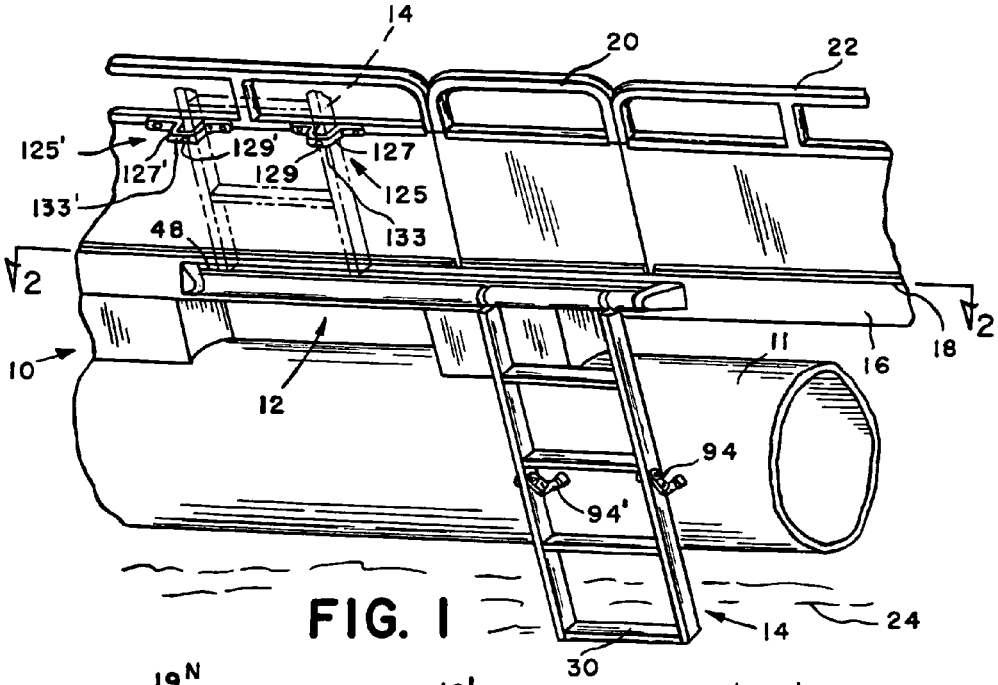
FIG. 1
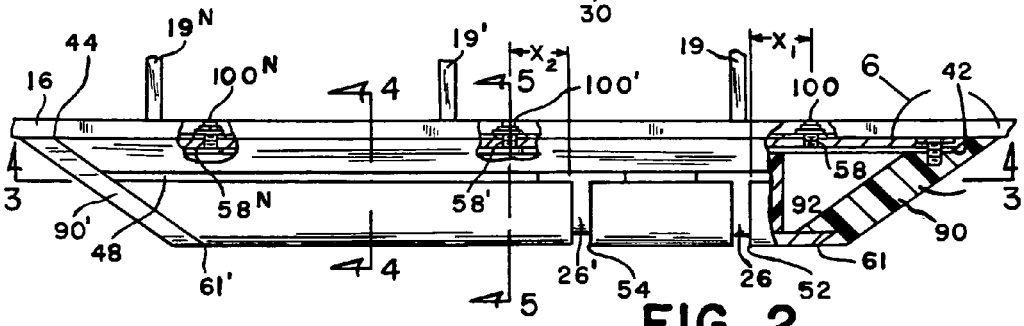
FIG. 2
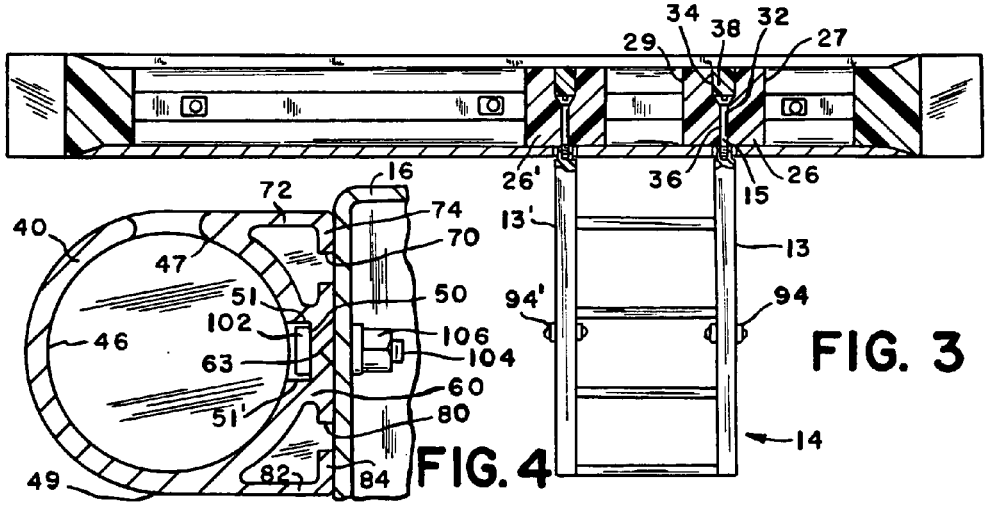
FIG. 3
FIG. 4

TRACK FOR LOCATING A LADDER WITH RESPECT TO A GATE ON A DECK

This invention relates to a track member through which a ladder is positioned with respect to a gate in a rail secured to a deck whereby a person may egress from a body of water into a watercraft.

BACKGROUND OF THE INVENTION

Pontoon boats are a popular watercraft for many people as they provide an operator with the ability to enjoy many water activities such as fishing, trolling, tubing, skiing, cruising and mooring. Most decks are enclosed by a rail, which extend about 2–3 feet from the deck and offer protection against being stepping into a body of water. The rail usually has gates along the side of the deck to permit a person to step from a dock onto the deck. It is not uncommon for a pontoon boat to lay anchor in a body of shallow water and use the deck as a platform for swimmers and as a result the swimmers open the gate to crawl onto the deck by a ladder that is lowered into the body of water. To provide ease in moving from the water onto the deck a ladder could be permanently attached to the deck that extends into the water however marine safety regulations stipulate that a first rung must extend into the water at least twelve inches. Unfortunately with a ladder in the water drag occurs and as a result the motion of the boat can be impaired. U.S. Pat. No. 4,846,303 discloses a two-position ladder that is attached top the deck of a watercraft and can be moved from the water and stowed out of the water when a boat is moving in a body of water. The ladder is retained on a track attached to the deck by a first bolt that extends through a first end of the track and a second bolt that extends through a second end of the track. The bolts are located at the extremity of the track and must carry the weight of a swimmer when egression from the water onto the deck. This type of structure functions in an adequate manner however when a pontoon boat is moving toward a dock the bolts and/or track are often the first to contact the dock and as a result the bolts transmit an impact force into the area of the deck surrounding holes through which the bolts are attached to the deck. Unfortunately after mooring at a dock with the track being impacted, the ladder does not easily move in the track and as a result it is often necessary to replace the track.

SUMMARY OF THE INVENTION

A primary object of the present invention is to provide a universally mountable track member for attaching a ladder to a deck of a watercraft whereby a person may ingress/egress from a body of water onto the deck.

According to this invention, the track member has a housing having a first end and a second end with a bore that extends from the first end to the second end. The housing has a linear slot that extends from the first end to the second end along a first vertical plane with respect to the bore and first and second vertical slots spaced from the first end. The housing has a radial projection that extends from the axis of the bore in a plane perpendicular to and 180° from the first and second vertical slots. The housing has an axial groove in the bore that is adjacent the radial projection that extends from the first end to the second end. The radial projection has a plurality of radial openings that are located at intervals between the first end and the second end of the housing with at least a first opening located in a first plane a first distance from the first vertical slot toward the first end, a second opening located in a second plane a second distance substantially equal to the first distance from the second vertical slot toward the second end and a third radial opening located adjacent the second end. The housing has a first leg that extends from the bore with a first lip located in a second vertical plane that is perpendicular to a base of the radial projection to define a second linear slot that extends from the first end to the second end and a second leg that extends from the bore with a second lip located in the second vertical plane to define a third linear slot that extends from the first end to the second end. The plurality of openings each receives a bolt with a head that is held by the axial groove and a shaft that extends through the radial projection and into the deck. A nut is secured to the shaft to urge the first and second lips and base of the radial projection into engagement with the deck to fix the track member to the deck. End caps are located in the bore at the first and second end such that a body covers the heads of bolts located in the first and third opening while the end caps have a slanted surface that extends from the base to an apex of the bore of the housing. The slanted surface deflecting any direct impact force away from the bolts such that the area of the deck surrounding the holes through which the bolts extend are adversely impacted. In situations where the plurality of openings are not properly aligned with supports member of the deck the track member is attached to the deck by locating bolts in either the second linear slot and the third linear slot with a head on each bolt being correspondingly held by engagement with the first leg and radial projection or by the second leg and the radial projection with the shaft of such bolt positioned in a hole that is selectively drilled in the support for the deck. A nut that is secured to this shaft to urge the first and second lips and base of the radial projection into engagement with the deck to fix the track member to the deck. As with the attachment bolts located in the axial groove, the end caps on the end of the track housing have a slanted surface and as a result the total impact of any force caused by deck hitting a deck is not carried into these attachment bolts. Cylindrical members attached to first and second legs of a variety of ladders are located in the bore of the housing and may be moved from the first end where the ladder provides for ingress/egress from a body of water to a storage position adjacent the rail. When adjacent the rail, the ladder may be collapsed or folded such that a view from the deck is not impaired.

An advantage of this invention resides a track member wherein bolts may be selective positioned with respect to a support stringer on a deck of a watercraft to attach the track member to a deck and where the bolts are covered and not subjected to a direct impact force should the watercraft hit a dock.

A further advantage of this invention is provided by an aligning groove that extends from the base of the track member to locate the selectively positioned bolt with respect to the support stringer of the deck.

A still further advantage of this invention is provided by the positioning of the attachment bolts to distribute impact loads throughout an entire length of the track and wherein end caps transfer any impact loads to the track without being damaged.

A further advantage of this invention provides for the attachment of a telescoping or folding ladder that is attached to a rail such that when stored against a rail a view from the deck is not impaired or detract from the aesthetics of a watercraft.

A further advantage of this invention resides in a track member having a housing with a bore therein with a projection that extends from the bore and an axial groove adjacent the projection with openings in the projection that bolts such that the head of a bolt is held by the axial groove and first and second legs that are parallel to the projection to define first and second axial slots between the first and second legs and the projection that selectively receive bolts such that a head is held between the first and or legs and the projection such that when a nut is secured to a shaft of a bolt the legs and a base of the projection are urged into contact with a support to fix the track to adjacent the deck of a water craft.

BRIEF DESCRIPTION OF THE DRAWINGS

FIG. 1 is a schematic illustration of a water craft with a track member made according to the principles of this invention for attaching a ladder to a deck whereby a person may climb from a body of water onto the deck of the water craft;

FIG. 2 is a view of the track member taken along lines 2—2 of FIG. 1 with a sectional view of various areas where the track member is attached to the deck of the water craft of FIG. 1;

FIG. 3 is a sectional view taken along lines 3—3 of FIG. 2;

FIG. 4 is a sectional view taken along lines 4—4 of FIG. 2;

In the detailed description wherein a component is fully described with respect on embodiment and it is part of a second embodiment, component is identified by the same number without further description in the second embodiment.

DETAILED DESCRIPTION

Figure 7:
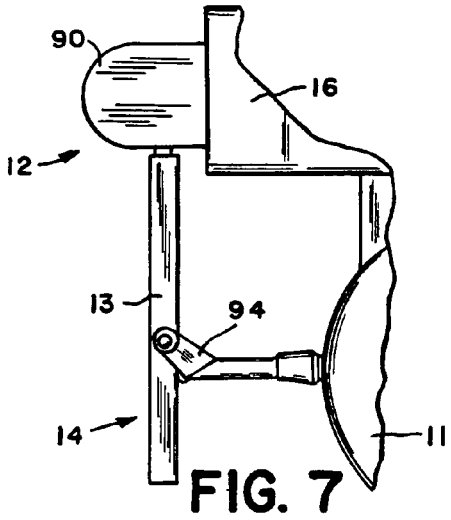
FIG. 7 is a side view of the water craft of FIG. 1 with the ladder attached to the deck and located in a vertical position with respect to the deck.

FIG. 1 is a schematic illustration of a water craft 10 having a track member 12 through which a ladder 14 is attached to a support 16 for deck 18 of the water craft 10. The ladder 14 is aligned on the track member 12 in a first vertical position with a gate 20 of a rail 22 to permit ingress/egress from a body of water 24 onto the deck 18 and in a second vertical or stow position shown by the dashed lines 14' adjacent the gate 20. The ladder 12 is attached to identical blocks 26,26' that move in the track member 12 between the second vertical position and first vertical position and on reaching the first vertical position being rotated 180° such that at least one rung 30 on the ladder 14 is located in the body of water 24. The track member 12 is attached to the support 16 by either a first plurality of bolts 100,100' . . . 100$^n$ that are located along a center line of a base on a projection 60 that extends from a housing 40 for the track member 12 or in first 70 or second 80 vertical slots respectively formed by a first leg 72 and the projection 60 or a second leg 82 and the projection 60. A head 102 on each bolt 100,100' . . . 100$^n$ is held by a axial groove 50 adjacent the projection 60 or between the first leg 72 and second leg 82 such that when a nut 106 is attached to a shaft 104 of each bolt 100, the track member 12 is fixed to the support 16 and the ladder 14 is affixed to the water craft 10.

In more particular detail, the track member 14 as shown in FIGS. 2, 3, 4, 5, 6, 8 and 9 is an extruded aluminum composition which is defined by a housing 40 having an first end 42 and a second end 44 with a bore 46 that extends from the first end 42 to the second end 44. The housing 40 has a center base 62 that extends from the first end 42 to the second end 44 and an end surface from the base 62 that has been shaped along a 45° angle toward an apex 61,61' such that each of the first 42 and second 44 ends begin at a point defined by apex 61,61' and end in a straight face on the end of base 62. The housing 40 has a linear slot 48 that extends from the first end 42 to the second end 44 along a first vertical plane with respect to the bore 46 and first 52 and second 54 vertical slots that are spaced from the first end 42. The housing 40 has a radial projection 60 that extends from the axis of the bore 46 in a plane perpendicular to and 180° from the first 52 and second 54 vertical slots. The housing 40 has an axial groove 50 in the bore 46 that is adjacent the radial projection 60 which extends from the first end 42 to the second end 44. The radial projection 60 has a plurality of radial openings 58,58' . . . 58$^n$ located at intervals between the first end 42 and the second end 44 of the housing 40.

An exact number of opening 58,58' . . . 58$^n$ is not set but at least three openings in the radial projection 60 is preferred with the first opening 58 being located in a first plane that is a first distance "$X_1$" from the first vertical slot 52 toward the first end 42, a second opening 58' being located in a second plane a second distance "$X_2$" that is substantially equal to the first distance "$X_1$" from the second vertical slot 54 toward the second end 44 and a third opening 58$^n$ being located adjacent the second end 44. Openings 58,58' receive attaching bolts 100,100' and are located adjacent the vertical slots 52,54 to provide for uniform input into the support 16 when weight is placed on ladder 14 by a person emerging from the body of water 24.

The housing 40 is further distinguished in that first 72 and second legs 82 are parallel and extend from the first end 42 to the second end 44 of base 62. The first leg 72 projects from cylindrical segment 47 of housing 40 adjacent linear slot 48 that form bore 46 and has a lip 74 that is located in a second vertical plane that is perpendicular to base 62 of radial projection 60 to define a second linear slot 70. The second leg 82 extends from a tangent of the cylindrical portion 49 of bore 46 opposite linear slot 48 and it too also has a lip 84 that is located in same second vertical plane of the base 62 of projection 60 to define a third linear slot 82. The first 74 and second 84 lips being designed to engage the support 16 and assist in maintaining the base 62 in the vertical plane defined by support 16. In addition the defined second 72 and third 82 linear slots that extend from the first end 42 to the second end 44 offer an opportunity to locate an attaching secondary bolts 200 anywhere on the support 16 that would be acceptable for transmitting forces into the structure of the water craft 10.

A preferred manner of attaching the track member 12 to support 16 is through the plurality of openings 58,58' . . . 58$^n$ that each receive a bolt 100. Each bolt 100 is identical and has a head 102 that is located in axial groove 50 such that the head 102 is held stationary by the side walls 51,51', a shaft 104 that extends through the radial projection 60 and into support 16 for deck 18, and a nut 106 that is secured to shaft 104 to urge first 74 and second 84 lips and base 62 of the radial projection 60 into engagement with support 16 to fix the track member 12 adjacent the deck 18.

Figure 8:
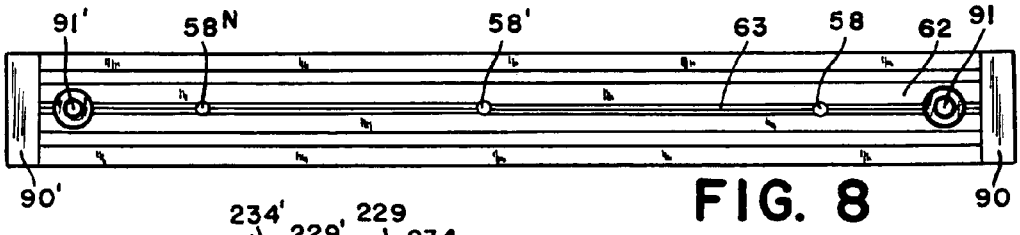
FIG. 8 is a view taken along lines 8—8 of FIG. 2.
Figure 10:
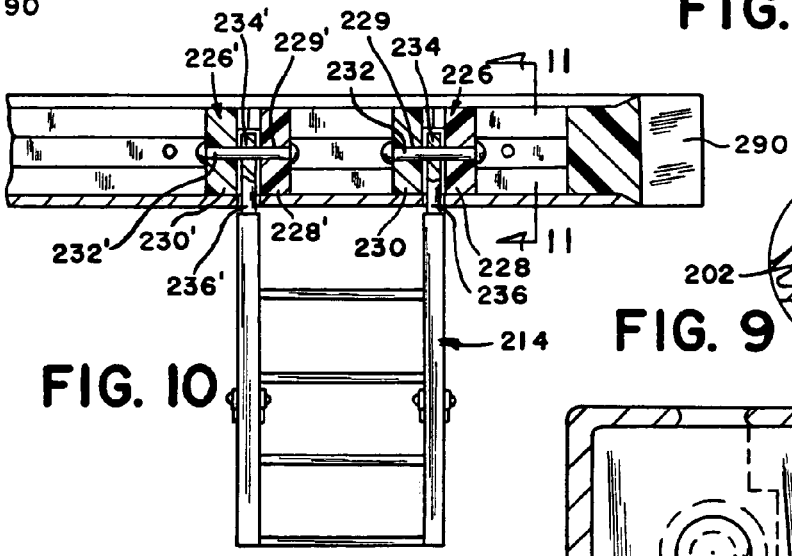
FIG. 10 is a sectional view of a second embodiment of a track member made according to the present invention for attaching a ladder to a deck of a watercraft.
Figure 9:
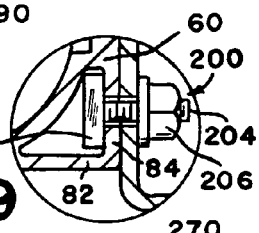
FIG. 9 is a view taken along the circumscribed line 9 FIG. 5.

The side support numbers 19,19' . . . 19$^n$ for the support structure 16 of some water craft 10 may not be located in a same location and in a best position for mounting the track member 12 in alignment with gate 20 and as a result openings 58,58' . . . 58$^n$ which are provided in track member 12 may not be appropriate and as a result new opening 581,581' . . . 58*ln* can be drilled along at a desired location along the v-shaped center line 63 of base 62 as shown in FIGS. 4 and 8 or a smaller second bolt 200, as shown in FIG. 9, can be selected to attach track member 12 to support 16. When a smaller second bolt is selected, either the second linear slot 70 or the third linear slot 80 can be utilized to receive any number of second bolts 200, they all be the same, to attach the track member 12 to support 16 in a desired location. The head 202 of a bolt is held the selected linear slot 70 or 80 by being located between leg 72, 82 and projection 60 such that head 202 that held from rotating by the engagement with the leg 72,82 and radial projection 60 while the shaft 202 of bolt 200 extends through support 16 at any location along the track member 12 from the first end 42 to the second end 44 that may be appropriate to carry a load into the support 16. When a nut 206 is secured to shaft 204 and tightened, the first 74 and second 84 lips and base 62 of the radial projection 60 are urged into engagement with the support 16 to affix the track member 12 adjacent the deck 18 in alignment with gate 20.

Bore 46 of housing 40 essentially has a smooth circular shape with a segment missing to define linear slot 48 and the first 52 and 52 vertical slots located adjacent end 42. Bore 46 has a first diameter that receives identical first 26 and second 26' cylindrical members which have a slightly smaller second diameter that allow for the cylindrical member 26,26' to move in bore 46 without binding. Each of the cylindrical members 26,26' have a first end 27 and a second end 29 with a cross bore 32 that is perpendicular to its axis with the cross bore 32 having a first diameter 34 and a second diameter 36. The first diameter 34 is larger than the second diameter 36 and extends from a first peripheral surface on a cylindrical member 26,26' to a surface that transitions into the second diameter 36 that extends to a second peripheral surface on the cylindrical member 26,26'. The cross bore 32 receives a attaching bolt 15 that is screwed into threads a side rail 13 of ladder 14 to fix a cylindrical member 26 to a side rail 13. The depth of the threads in the side rail 13 is such that when the matching threads on attaching bolt 15 are tightened therein a gap exist between the cylindrical body 26,26' and the top of the side rail 13. A plug 38 is located in first diameter of the cross bore 32 to close the cross bore 32 and maintain a smooth peripheral surface on the cylindrical body 26,26' and the size of attaching bolt 15 has a smaller diameter than the linear slot 48 and the first 52 and second 54 vertical slots such that movement of a cylindrical member 26, 26' in bore 46 between first and second positions for the ladder 14 is not hindered.

Figure 6:
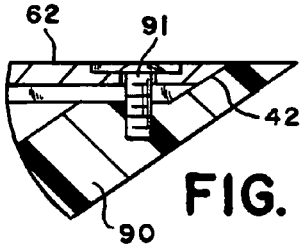
FIG. 6 is an enlarged sectional view taken along the circumscribe line 6 of FIG. 2.

Bore 46 is closed and the cylindrical bodies 26,26' are retained therein end caps 90,90' that are respectively attached to ends 42,44. Each end cap 90,90' has a cylindrical body 92 that extends into bore 46 a sufficient length to respectively cover head 102 of a bolt 100 located in the first opening 58 and head 102$^n$ of bolt 100$^n$ in third opening 58$^n$. The first 90 and second 90' end caps each having a surface that extends from alignment with base 62 of projection 60 along the 45° angle toward an apex 61 to match the radial peripheral surface of housing 40 and also functions to transmit any impact force received to the end 42 or 44 into the track member 12 in a manner such that the entire force is not directly communicated into first 100 and/or second 200 bolts selected to attach the track member 12 to the support 16. End caps 90,90' are respectively attached to housing 40 by screws 91,91 as best shown in FIG. 6.

When the ladder 14 is in the first vertical position is desirable that the ladder 14 remain in this position without placing too great a lateral force on bolts 100 or 200 which everyone is selected and as a result a stand-off member 94,94' is attached to each side rail 13,13'. The stand off member 94,94' engages structure such as a pontoon 11 on watercraft 10 when ladder 14 is in the water and holds the ladder 14 is a vertical position. The stand off member 94,94' is designed such that it may engage the side rail 22 to also assist in retaining the ladder 14 in a vertical position when the ladder 14 is positioned in its second vertical position adjacent gate 20.

A more positive means of retaining a ladder 14 in the second vertical position is defined by latch members 125, 125' that are attached to rail 22. Each of the latch members 125,125' have a first strap 127,127' with a snap 129,129' on the end thereof that receive head on a second strap 131,131' both of which are attached to a side rail 13,13' to assist in holding the ladder 14 in the second vertical position. A cord 133,133' extends from the first strap 127,127' such that a person in the water may undo the snap and pull ladder 14 into the water should ingress be necessary.

It is understood that a different latch such a Velcro type strap with a cord thereon or parallel first and second resilient fingers that are attached to the rail 22 that could engage the side rails 13,13' and assist in holding the ladder 14 in the second vertical position adjacent the gate 22.

Figure 12:
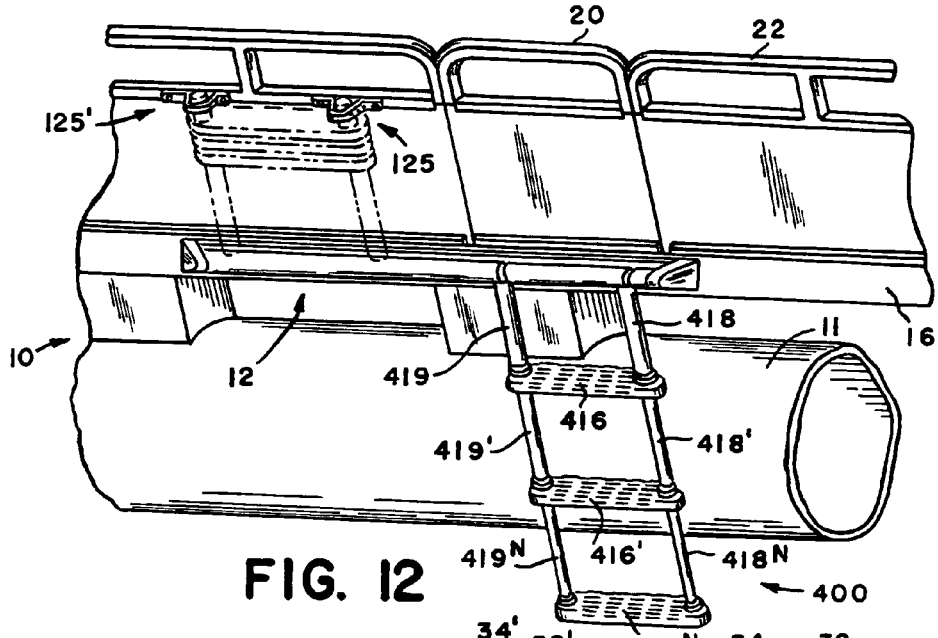
FIG. 12 is a schematic illustration of a water craft with a track member made according to the principles of this invention for attaching a telescoping ladder to a deck of the water craft.
Figure 13:
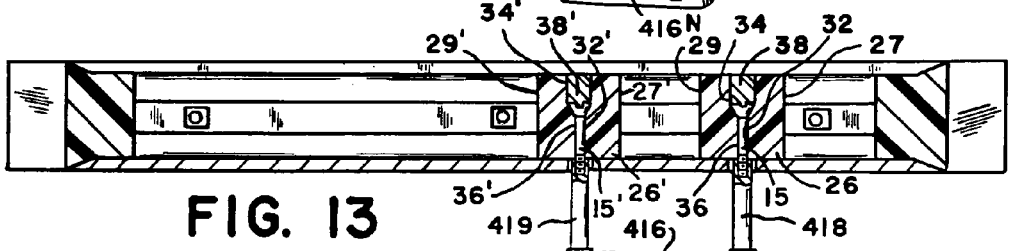
FIG. 13 is a sectional view of the track of FIG. 12.

The uniform length ladder 14 shown in FIG. 1 may be replaced by a ladder 400 as shown in FIGS. 12 and 13 wherein the rungs 416,416' . . . 416$^n$ are connected to tubular side rails 418,418' . . . 418$^n$ and 419,419' . . . 419$^n$. Side rails 418,418' . . . 418$^n$ and 419,419' . . . 419$^n$ have a progressive smaller diameter that telescope into each other. Tubular side rails 418 and 419 have a solid end 420,420' that is threaded to receive threads on attaching bolts 15,15' that respectively extends from blocks 26,26' located in bore 46 of housing 40 of track member 14. As illustrated in FIG. 12, the tubular side rails 418,418' . . . 418$^n$ and 419,419' . . . 419$^n$ collapse from a first length in the first vertical position when the ladder 400 is in the body of water 24 to a smaller second length in the second vertical position shown in phantom in FIG. 12 as the smaller diameter section move into the larger diameter sections. In this second collapsed position, the top of the end rung 420 is engaged by latch 125,125' and is located below the top of rail 22 so as not to interfere with a view of a person on deck 18.

Figure 14:
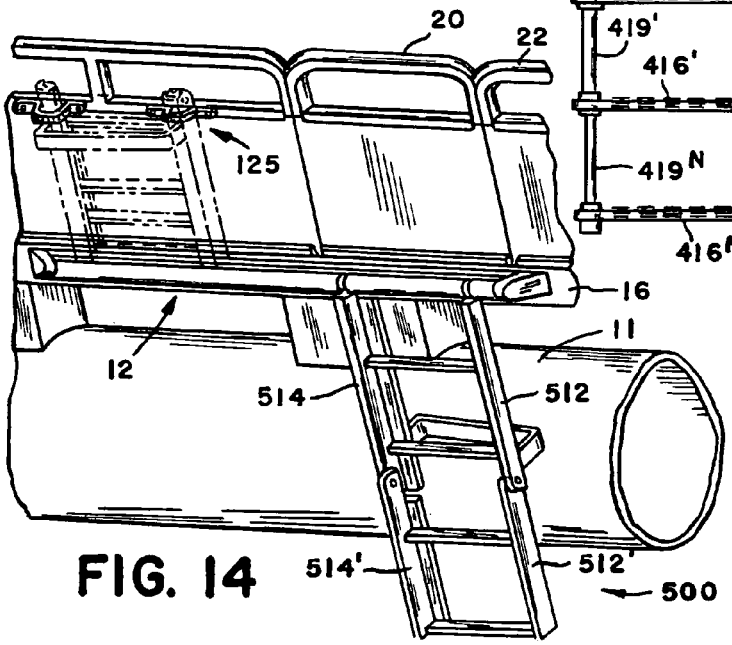
FIG. 14 is a schematic illustration of a water craft with a track member made according to the principles of this invention for attaching a folding ladder to a deck of the water craft.

The uniform length ladder 14 shown in FIG. 1 may be replaced by a ladder 500 shown in FIG. 14 having a first section 510 with first 512 and second 512' side rails and a second section 514 with third 516 and fourth 516' side rails. The length of the first section 510 and the length of the second section 514 are approximately the same with the first side rail 512 connected to the first side rail 514 by a first pin 520 and the second side rail 512' connected to the second side rail 514' by a second pin 520'. The first section 510 has a U-shaped projection 594 that extends from the back side of side rails 512,512' to define a hold off that engages pontoon 11 to maintain ladder 500 in the first vertical position. Rungs 522 and 524 are located in the first section 510 while rungs 526 and 528 are located in the second section 514 such that a uniform spacing occurs for the ladder 500 as shown in the first vertical position to define a first length with the ladder 500 in the first vertical position in alignment with gate 20. The second section 514 is folded into the first section by pivoting on pins 520,520 the rungs nestle together into a compact structure. Thereafter, when ladder 500 is rotated into the second vertical position, the smaller second length is such that ladder 500 does not extend above the top of rail 22 and as a result the view from the deck 18 is not obstructed. In this embodiment, a latch member 125,125' also engages the side rails 512,512' to assist in holding the collapsed ladder 500 in the second vertical position.

Figure 5:
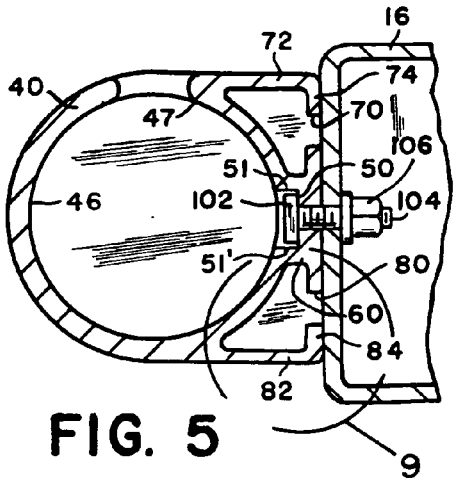
FIG. 5 is a sectional view taken along lines 5—5 of FIG. 2.
Figure 11:
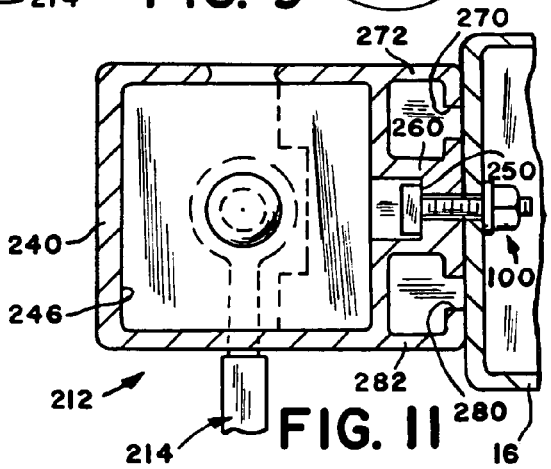
FIG. 11 is a sectional view taken along lines 11—11 of FIG. 10.

For some applications, housing 240 and resulting bore 246 may be extruded in an rectangular shape as illustrated in FIG. 11 rather than a circular shape as illustrated in FIGS. 4 and 5. In this embodiment, housing 240 has an rectangular bore 246 for receiving corresponding first 226 and second 226' rectangular blocks through which ladder 14 is attached to track member 214. The first 226 and second 226' rectangular blocks are identical and as shown have a first member 228 with a vertical slot 230 therein although two part with a spacer therein would work in an equally well manner. As shown the first 228 and second 228' members have an axial bore 229 there through for receiving a pin 232. Pin 232 retain an eye 234 on a bolt 236 connected to a nut located in end face of side rail 13 of ladder 14. The slot 230 or spacer is designed to have a greater width than eye 234 such that bolt 236 can rotate on pin 232 and correspondingly a ladder 14 may to rotate between the first and second vertical positions blocks 226,226' remain stationary in the first vertical position in track member 214 while blocks 226,226' may be moved without binding in the rectangular bore 246 as the ladder 14 is moved between the first and second positions. As with housing 40, housing 240 has an axial groove 250 adjacent a radial projection 260 for receiving a bolt 100 and corresponding legs 272,282 which along with radial projection 260 define a second linear slot 270 and a third linear slot 280 for selectively receiving a bolt 200 to attach track member 212 to a support for a deck 18 of a water craft 10. As with track member 14, end caps 290,290' are attached to the ends 242,244 to close the bore 246 and also provide a surface through which an impact force applied to the end 242 or end 244 are transmitted into the bolts selected to attach the track member 214 to support 16.

In any event the number and pattern for bolts 100 or 200 may be with three bolts in axial groove 50, 250, one bolts in axial groove 50,250 and two bolts in either slots 70,80 or 270,280 or three or four bolts in either slots 70,80 or 270,280 to selectively attach track member 12,214 to support or stringer 16 for the alignment of a ladder 14,400 or 500 with a gate 20 on a deck 18 and as a result any impact force received by the track member 12,214 is uniformity transferred along its entire length into the support or stinger 16 of the deck.

I claim:

1. A track member through which a ladder is attached to a deck of a water craft, said ladder being aligned on said track member in a first vertical position with a gate of a rail to permit ingress/egress between a body of water and deck and in a second vertical position adjacent to said gate, said ladder being movable on said track from said second vertical position to said first vertical position and being rotated 180° such that at least one rung on the ladder is located in the body of water, said track being characterized by a housing having an first end and a second end with a bore that extends from said first end to said second end, said housing having a linear slot that extends from said first end to said second end along a first vertical plane with respect to said bore and first and second vertical slots spaced from said first end, said housing having a radial projection that extends from the axis of said bore in a plane perpendicular to and 180° from said first and second vertical slots, said housing having an axial groove in said bore and adjacent said radial projection that extends from said first end to said second end, said radial projection having a plurality of radial openings located at intervals between said first end and said second end of said housing with at least a first opening located in a first plane a first distance from said first vertical slot toward said first end, a second opening located in a second plane a second distance substantially equal to said first distance from said second vertical slot toward said second end and a third radial opening located adjacent said second end; said housing having a first leg that extends from said bore with a first lip located in a second vertical plane that is perpendicular to a base of said radial projection to define a second linear slot that extends from said first end to said second end and a second leg that extends from said bore with a second lip located in said second vertical plane to define a third linear slot that extends from said first end to said second end, said plurality of openings being selectively available for receiving first bolt means, said first bolt means being defined by a first bolt having a head that is held by said axial groove and a shaft that extends through the radial projection and into said deck, and a nut that is secured to said shaft to urge said first and second lips and said base of said radial projection into engagement with the deck to fix said track member to said deck, said second linear slot and said third linear slot being selective available for receiving second bolt means, said second bolt means being defined by a second bolt having a head that is held by engagement with said first leg and said radial projection or by said second leg and said radial projection with a shaft that extends into said deck and a nut that is secured to said shaft to urge said first and second lips and said base of said radial projection into engagement with the deck to fix said track member to said deck.

2. The track member as recited in claim 1 wherein said housing is characterized by said first and second ends each having an end cap with a body that extends into said bore, said body having a length that covers said head of a bolt located in said first and third openings, said first and second end caps each having a surface that extends from alignment with said base of said radial projection along a 45° angle toward an apex such that any force applied to said track member is not directly communicated into said selected first and second bolt means.

3. The track member as recited in claim 1 wherein said bore is characterized by having a first diameter that receives first and second cylindrical members which have a second smaller diameter, each of said cylindrical members having a first end and a second end with a cross bore perpendicular to an axis of said cylindrical members, said cross bore having a first diameter and a second diameter, said first diameter being larger than said second diameter and extending from a first peripheral surface on the cylindrical member to a surface that transitions into said second diameter that extends to a second peripheral surface on said cylindrical member, said cross bore receiving an attaching bolt that is screwed into a side rail of said ladder to fix the cylindrical member to a side rail and a plug that is located in said first diameter to close said cross bore, said attaching bolt having a smaller diameter than either said linear slot or said first and second vertical slots such that movement of the cylindrical member in said bore between said first and second positions is not hindered.

4. The track member as recited in claim 1 wherein said bore is characterized by being rectangular and receives correspondingly substantially first and second rectangular blocks, each of said first and second rectangular blocks having a first member that is separated from a second member by a spacer with an axial bore through said first and second members, a pin that extends through said axial bore joins said first member with said second member to retain an eye on a bolt there between, said bolt being attached to a side rail of said ladder, said spacer allowing said eye to rotate on said pin and correspondingly said ladder to rotate between said first and second vertical positions while said blocks remain stationary, said blocks being moved in said rectangular bore as said ladder is moved between said first and second positions without binding.

5. The track member as recited in claim 1 wherein said ladder is characterized by a stand-off attached to a side rail that engages structure on said water craft when said ladder is in said first vertical position.

6. The track member as recited in claim 5 wherein said stand-off attachment is characterized by engaging said rail on said deck when said ladder is in a first vertical position to assist in retaining said ladder in said second vertical position.

7. The track member as recited in claim 1 wherein said ladder is characterized by being collapsible from a first length in said first vertical position to a smaller second length in said second vertical position.

8. The track member as recited in claim 7 wherein said ladder is further characterized by a plurality of side rails having a decreasing diameter that telescope into each other and on being rotated from said first vertical position into said second vertical position the smaller diameter side rails move into the larger diameter rails to achieve said smaller second length.

9. The track member as recited in claim 7 wherein a latch member engages said ladder to assist in maintaining said ladder in said second vertical position.

10. The track member as recited in claim 1 wherein said ladder is characterized by a first section that has first and second a side rails and a second section that has third and fourth side rails, said first side rail being connected to said third side rail by a first pin and said second side rail being connected to said fourth side rail by a second pin, said first and second section being aligned to define said first length and said second section being folded into said first section by pivoting on said first and section pins to define said smaller second length.

11. The track member as recited in claim 1 wherein said base of said radial projection is characterized by a v-shaped center line to provide for alignment of said track with respect to said deck.

* * * * *